United States Patent [19]

Spieth et al.

[11] 4,195,840

[45] Apr. 1, 1980

[54] TARGET CHANGER FOR USE ON A SHOOTING RANGE

[75] Inventors: Ernst K. Spieth, Fritz-Müller-Strasse 145, 7301 Esslingen-Zell, Fed. Rep. of Germany; Bernhard Murso, Esslingen-Zell; Eberhard Riedmüller, Blaubeuren-Seissen, both of Fed. Rep. of Germany

[73] Assignee: Ernst K. Spieth, Esslingen, Fed. Rep. of Germany

[21] Appl. No.: 887,905

[22] Filed: Mar. 17, 1978

[30] Foreign Application Priority Data

Mar. 25, 1977 [DE] Fed. Rep. of Germany ..... 2713364
Sep. 16, 1977 [DE] Fed. Rep. of Germany ..... 2741743

[51] Int. Cl.[2] ..... A63B 63/00; F41J 1/14
[52] U.S. Cl. ..... 273/406; 273/404
[58] Field of Search ..... 273/105.6, 102.4

[56] References Cited

U.S. PATENT DOCUMENTS 2,931,655 4/1960 Hudkins ..... 273/105.6

FOREIGN PATENT DOCUMENTS 1163194 2/1964 Fed. Rep. of Germany ..... 273/105.6
2433792 1/1976 Fed. Rep. of Germany ..... 273/105.6

*Primary Examiner*—George J. Marlo
*Attorney, Agent, or Firm*—Pollock, Vande Sande & Priddy

[57] ABSTRACT

A target changer for use on a shooting range which after each actuation by an operator automatically removes a used target from a window in the target stand and brings a fresh target into the window. The target changer is designed to change individual targets which are not joined together. A supply magazine disposed above the window receives a stack of targets, and a first feed mechanism conveys the frontmost target of the stack to a vertical target guide disposed behind the window, while a second feed mechanism disposed at the lower end of the target guide conveys the used target from the target guide to a used target receiver. In some embodiments additional advancing rollers are arranged on both sides of the target guide to ensure a forced transport of the targets between the two feed mechanisms, whereby jamming is avoided.

The target changer can be adapted to targets of different sizes by means of inserts which are inserted into the target window. These inserts may also be provided with additional advancing rollers.

20 Claims, 10 Drawing Figures

TARGET CHANGER FOR USE ON A SHOOTING RANGE

BACKGROUND OF THE INVENTION

1. Field of the Invention

This invention relates to target changers for use on shooting ranges which after each actuation by an operator automatically remove a used target from a window in the target stand and bring a new target into the window so that said target is visible to the marksman for firing. This invention relates more particularly to a target changer of this type by which individual targets which are not joined together in the form of webs can be changed.

2. Description of the Prior Art

A target changer of this type is known from German Offenlegungsschrift 2,433,792. This known target changer comprises a supply magazine which is disposed above the level of a window and constructed to receive a stack of targets, a transport mechanism driven by an electric motor for conveying the respective first target of the stack to a vertical target guide disposed behind the window, and a used target receiver beneath the level of the window for receiving the targets discharged downwardly from the target guide.

At the lower end of the vertical target guide, a retractable target stop is disposed so that in its inoperative position it is in the path of the target located in the target guide, and a curved deflection member is disposed beneath said retractable stop. To remove a used target from the target guide, the stop is retracted so that the target drops out downwardly and is deflected by the deflection member to the used target receiver upon which it is deposited face downwards. The supply magazine containing the target stack is mounted almost horizontally in the upper portion of the target changer pivotally about a horizontal axis so that it is pressed by inequilibrium positively against a feed roller. Between the supply magazine and the vertical target guide there is an arrangement of curved guide and brake plates which conduct the target delivered by the feed roller from the supply magazine to the entry of the target guide, where a further pair of feed rollers is disposed.

With this known target changer, there is a danger that a used target will not drop out of the vertical guide when the stop is retracted, for the bullet holes in a used target have jagged, rearwardly projecting edges as a result of which the target may remain stuck in the guide. This can cause obstructions in the target guide which are troublesome to remove. Even if the target drops out of the target guide, the projecting edges of the bullet holes may prevent the targets conducted by the deflection member to the used target receiver from sliding smoothly over each other and cause them to stick together, and this can also lead to congestion. Finally, the approximately horizontal position of the supply magazine in the upper part of the target changer involves considerable construction expenditure with significant overall depth, and charging of the supply magazine is made difficult.

SUMMARY OF THE INVENTION

It is therefore an object of the present invention to provide an improved target changer which has a simpler construction and in which the danger of sticking or jamming in the target guide and in the used target receiver is obviated.

The target changer according the invention comprises a supply magazine disposed above the level of a window and adapted to receive a stack of targets, a first feed mechanism driven by an electric motor for conveying the respective first target of the stack to a vertical target guide disposed behind the window, a used target receiver disposed beneath the level of the window for receiving the targets discharged downwardly out of the target guide, and a second feed mechanism driven by the electric motor and disposed at the lower end of the target guide so as to engage the target disposed in the target guide and to convey said target out of the target guide to the used target receiver.

The second feed mechanism is preferably formed by a conveying roller pair which is disposed at the lower end of the target guide as support for the lower edge of the target disposed in the target guide, and beneath the second feed mechanism and above the used target receiver a stop is arranged in the path of the target conveyed downwardly by the second feed mechanism.

As a result of the construction of the target changer according to the invention each target is positively withdrawn from the target guide, the conveying roller pair overcoming any resistance which might be caused by jagged projecting edges of the bullet holes. The removed target is further positively urged by the conveying roller pair with the lower edge against the stop, so that on further advancing it arches rearwardly over the stack disposed in the used target receiver. As soon as the upper edge of the target has left the conveying roller pair, the target jumps rearwardly due to its intrinsic resiliency and drops back downwards onto the top of the stack disposed in the used target receiver. Mutual catching of the jagged edges of the holes in used targets is thus made impossible. At the same time, this construction of the used target receiver substantially reduces the overall height of the portion disposed beneath the target guide.

A further advantage of the target changer according to the invention results from the location of the supply magazine vertically above the target guide in such a manner that the frontmost target of the stack is disposed above the entry of the target guide. This reduces the construction expenditure because no guide or brake plates and additional feed rollers are needed between the supply magazine and the target guide. Above all, however, the overall depth is substantially reduced and charging of the supply magazine is facilitated.

The indicated construction makes it possible to mount the supply magazine, the feed mechanism, the target guide and the conveying roller pair on a vertical frame adapted to be suspended behind a vertical wall containing the window.

As a result, the entire target changer forms a single structural unit which can be suspended in its own housing or, alternatively, behind any wooden, concrete, steel or other shooting range wall containing a target window.

In a preferred embodiment the supply magazine is disposed vertically above the target guide in such a manner that the frontmost target of the stack is disposed above the entry of the target guide, and the first feed mechanism comprises a feed roller driven by the electric motor and bearing on the frontmost target above the target guide. Furthermore, a means is provided which switches off the electric motor when the upper edge of the target has left the feed roller. Said means may be a limit switch whose actuating member projects beneath the feed roller into the path of the target conveyed from the supply magazine to the target guide, the contacts of said limit switch being inserted in the circuit of the electric motor driving the feed mechanisms.

In this embodiment of the target changer, to change a target a pushbutton switch starting the electric motor is briefly actuated. This drives the feed rollers so that the upper feed roller conveys the frontmost target of the stack out of the magazine downwardly into the target guide while at the same time the lower conveying roller pair conveys the used target previously disposed in the target guide away downwardly. As soon as the target conveyed out of the supply magazine reaches the actuating member of the limit switch, the latter is actuated so that it maintains the circuit of the electric motor closed even after release of the pushbutton switch. The feed roller and the conveying roller pair will thus continue to be driven until the target coming from the magazine has left the upper feed roller. Said target then drops due to its own weight downwardly into the target guide and thus releases the limit switch. This stops the electric motor and the new target is ready to be shot at.

It has been found that under certain conditions a further cause of disturbances in operation of a target changer of this type is that the target conveyed from the magazine does not drop downwardly after leaving the upper feed roller, or does so only very slowly. This may be caused in particular by strong wind which presses the targets against cardboard inserted as stiffening means into the target guide. Because the target remains stuck, it does not release the actuating member of the limit switch and the electric motor thus runs on. The feed roller continues to be driven and immediately delivers the next target from the magazine. This can lead to jamming, or alternatively the stuck target is pushed downwardly by the succeeding target so that it is led away downwardly by the lower conveying roller pair without having been used.

According to a further advantageous embodiment of the invention, this phenomenon is obviated by arranging between the upper feed roller and the lower conveyer roller pair on each side of the target guide an advancing roller adapted to be driven by a motor and disposed in such a manner that said advancing rollers engage the marginal portions of the target disposed in the target guide.

This embodiment of the target changer provides a forced feed of the target over the entire path from the upper feed roller to the lower conveying roller pair and consequently the targets cannot stick even in strong winds.

This improvement can also be employed whenever an insert insertable into the target guide is provided for adapting the target changer to targets of smaller size.

In this case an advancing roller adapted to be driven by a motor is disposed on each side of the target guide of the insert so that said advancing rollers engage the marginal portions of the target disposed in the target guide of the insert.

DESCRIPTION OF PREFERRED EMBODIMENTS

Figures 1, 4:
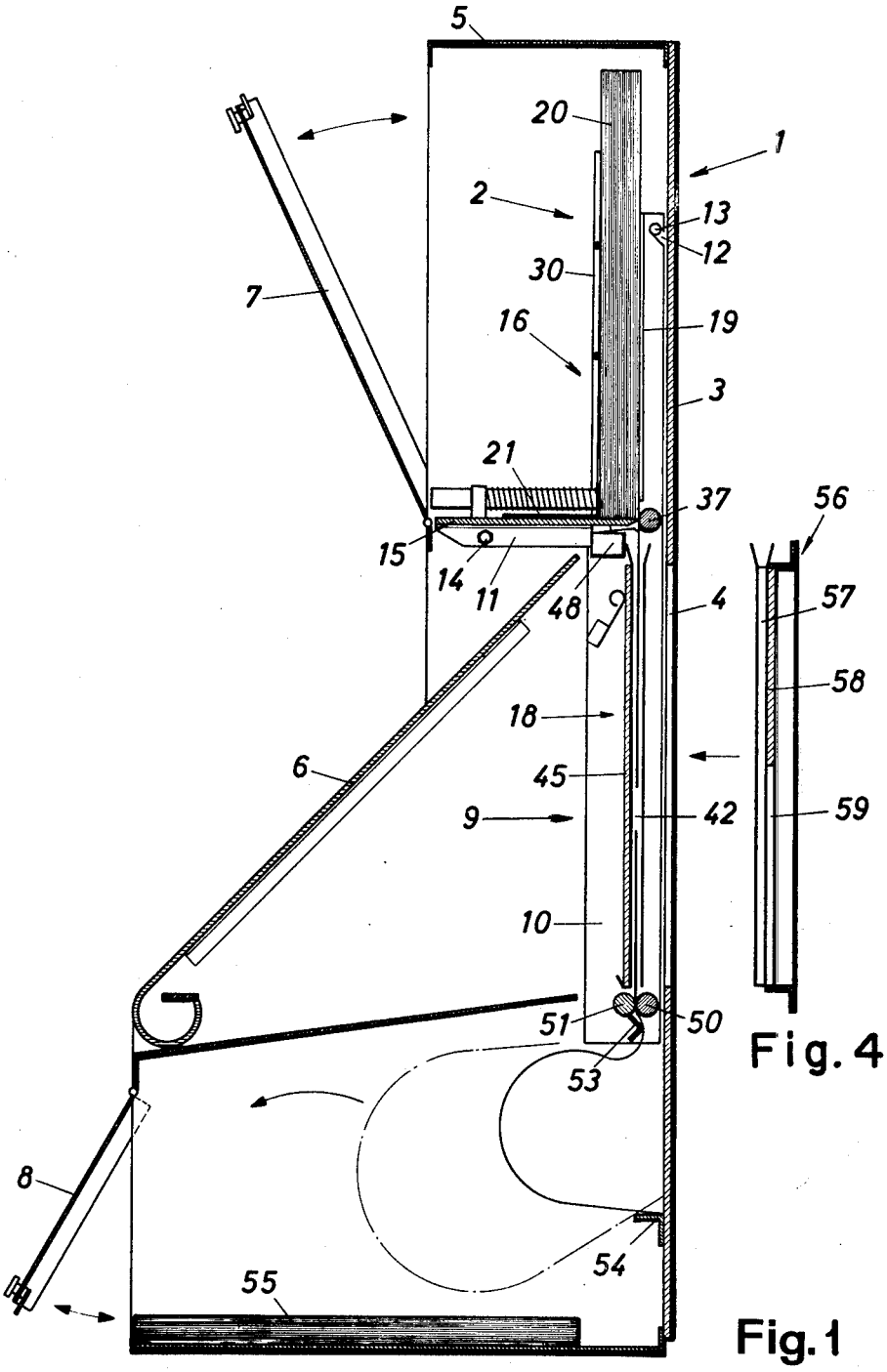
FIG. 1 is a lateral sectional view of a first embodiment of the target changer of the present invention.
FIG. 4 is a lateral sectional view of an insert for smaller size targets insertable into the target guide of the target changer of FIG. 1.

Referring to the drawings, the target changer illustrated in FIG. 1 consists of two substantially independent structural units, i.e., a housing 1 and a target changer mechanism 2. The housing comprises a bulletproof front plate 3 in which a window 4 is disposed and a sheet-metal casing 5 which forms the side, bottom and top walls of the housing. Behind the window 4 a replaceable bullet trap 6 is disposed. At the upper portion of the housing there is a flap 7 at the rear wall which can be opened to provide access to the target magazine disposed in this portion, and at the rear wall of the lower portion a flap 8 permits access to the used targets deposited in the lower portion of the housing.

The target changer mechanism 2 is mounted as an independent structural unit on a mounting frame 9, of which in the sectional views of the drawings a lateral vertical beam 10 and a horizontal beam 11 projecting rearwardly substantially in the center of the vertical beam are visible. Corresponding parts are of course present on the other side not visible in the drawings. The mounting frame 9 is connected to the housing 1 simply by providing at the upper portion of each vertical beam 10 at the front edge thereof an inclined slot 12 which engages a pin 13 secured to the housing 1. For additional attachment a screw 14 may be led through a bore in each horizontal beam 11 and screwed to the housing in a suitable manner. It is thus obvious that the target changer mechanism is a self-contained unit which can easily be detached from the housing 1 and can be incorporated in the same manner also without the housing behind an existing wooden, concrete, steel or other target wall of a target stand without affecting the function of the target changer mechanism and without requiring any structural modifications.

The two lateral horizontal beams 11 of the mounting frame 9 are connected to one another by a horizontal plate 15 which divides the target changer mechanism into two halves; above the plate 15 are the magazine 16 for the targets and the drive motor 17 (FIG. 2), while beneath the plate 15 there is essentially the vertical target guide 18.

The magazine 16 disposed in the upper portion of the mounting frame 9 is adapted to receive a stack 20 of targets standing upright on the plate 15 and comprises a vertical front support plate 19 against which the frontmost target of the stack 20 bears. A pressure means disposed behind the target stack 20 on the plate 15 holds the target stack in the vertical position and presses it constantly against the support plate 19. Said pressure means consists essentially of a carriage 21 which is horizontally displaceable on rollers 22 (FIG. 3) in guide grooves 23 of the plate 15.

The carriage 21 carries at the front end a vertical pressure plate 24 which bears on the rearmost target of the stack 20. The carriage further carries a guide rod 25 projecting rearwardly horizontally a slight distance above the plate 15 and guided slideably through an opening in an abutment 26 mounted on the plate 15, which guide rod carries a pressure spring 27 which bears against the abutment 26 so that said spring tends constantly to press the carriage forwardly against the target stack. A roller 28 running in a slot 29 of the plate 15 is provided at the lower side of the carriage 21 and limits the displacement of said carriage in both directions. Furthermore, a rearwardly pivotal bracket 30 is mounted on the carriage and in its upwardly pivoted position (FIGS. 1 and 2) bears against the rear of the target stack and thus holds the latter in the vertical position. The bracket is held by holders 31 which are disposed on the carriage 21 on both sides behind the pressure plate 24. Each bracket holder 31 comprises a vertical slot 32 into which a bent end 34 of the bracket engages, and at the upper edge a cutout 33 into which a pin 35 on the bracket can engage when the latter is vertical. Furthermore, the bracket carries a transverse rod 36 which can be engaged behind the abutment 26 when the bracket 30 is in the rearwardly pivoted position as shown in FIG. 3.

The lower edge of the support plate 19 is disposed a certain distance above the horizontal plate 15, and on the thus exposed lower portion of the frontmost target of the stack 20 a feed roller 37 bears which is rotatably mounted in the mounting frame 9 and is connected via a drive chain 39 to the motor 17. The feed roller 37 may be a cylinder extending essentially across the entire width of the targets. The front edge 38 of the plate 15 facing the feed roller 37 is bevelled to a point and is spaced from the feed roller 37 by a distance which corresponds substantially to the thickness of a target. This assures that upon each rotation of the feed roller, only one target can be withdrawn from the stack 20 while the remaining targets are held back by the plate 15.

The target guide 18 disposed in the lower portion of the mounting frame 9 is formed by providing at each lateral beam 10 two vertical guide angle members 40, 41 spaced from each other so that a guide slot 42 is formed therebetween whose width is somewhat greater than the thickness of a target, said slot lying exactly vertically below the exit gap of the magazine 16 which is formed between the feed roller 37 and the front edge 38 of the plate 15. Bevelled portions at the upper end of each guide angle member 40, 41 provide a funnel-like widened portion 43 which facilitates introduction of the target into the guide slot 42. A target introduced into the vertical guide slots 42 at both sides of the mounting frame is thus held at the two lateral longitudinal edges. To stabilize the target a replaceable cardboard 45 is provided which is placed in bent-over supports 46 at the lower ends of the rear guide angle members 41 and pressed by a pressure spring 47 against the guide angle members 41.

Provided at the upper end of the target guide 18 is a limit switch 48 so that its actuating finger 49 projects into the path of the target conveyed from the magazine 16 to the target guide 18.

Disposed beneath the target guide 18 is a pair of conveying rollers 50, 51 comprising a drive roller 50 connected via a drive chain 52 to the upper feed roller 37, and an idling pressure roller 51. The conveying rollers 50, 51 may be cylinders extending essentially across the entire width of the target guide 18. The nip formed between the two conveying rollers 50, 51 is disposed exactly vertically beneath the guide slot 42. Beneath the conveying roller pair 50, 51 a deflector 53 formed by a horizontal angle iron is disposed so that it deflects each target emerging from the feed roller pair forwardly. A stop angle 54 is disposed beneath the feed roller pair at the inside of the front plate 53 of the housing 1 at a predetermined spacing which is smaller than the height of a target.

The target changer described operates in the following manner: Assuming that the parts are in the position illustrated in FIG. 2 in which a stack 20 of targets is introduced into the magazine 16, held by the upwardly pivoted bracket 30 in the vertical position and pressed by the pressure means formed by the carriage 21 forwardly against the support plate 19.

To introduce a target into the target guide 18, the operator presses a pushbutton switch, which is not illustrated, and this starts the motor 17. Via the chains 39 and 52 the motor 17 drives the feed roller 37 and the conveyor roller 50, but at first the drive of the conveying roller 50 has no effect, assuming that no target is disposed in the target guide 18. On the other hand, the feed roller 37 conveys the frontmost target of the stack 20 out of the magazine 16 downwardly into the target guide 18. The lower edge of the target strikes the actuating finger 49 of the limit switch 47 which is thus closed and keeps the circuit of the motor 17 closed even after release of the pushbutton switch. The target is thus conveyed further downwardly into the target guide 18 until its upper edge leaves the feed roller 37; it then drops the remaining distance downwardly, releasing the actuating finger 49 of the limit switch 47 so that the latter interrupts the circuit of the motor 17. The motor is thus stopped. The lower edge of the target which has dropped into the target guide falls into the nip between the conveying rollers 50, 51, which are stationary and serve as support for the target.

The target is now disposed in the target guide 18 and can be used for firing practice in the desired manner.

To replace a used target with a fresh one, the operator again presses the pushbutton switch, restarting the motor 17. The next target is thus conveyed in the previously described manner out of the magazine 16 into the target guide 18. However, at the same time the used target is extracted by the conveying roller pair 50, 51 downwardly out of the target guide, even when the target offers a certain resistance to this movement, due, for example, to the jagged edges in any bullet holes. The deflector 53 deflects the target forwardly so that its lower edge moves downwardly at the inside of the wall 3 and meets the stop angle 54. One further advancing of the target by the conveying rollers 50, 51 said target arches rearwardly in the manner indicated in FIG. 1 because its lower edge is in fixed position. As soon as the upper edge of the conveyed target is free of the conveying roller pair 50, 51, the target jumps rearwardly due to its inherent resiliency and drops back downwards onto the used target stack 55 accumulating on the bottom of the housing 1. By opening the flap 8, the used targets can be removed as desired.

To replenish the supply magazine 16, the upper flap 7 is opened and the bracket 30 pivoted rearwardly, which is done by slightly raising said bracket so that the pin 35 leaves the cutout 33. The carriage 21 is then drawn rearwardly against the force of the pressure spring 27 and held in the retracted position by engaging the transverse rod 36 of the bracket 30 behind the abutment 26 (FIG. 3). A fresh target stack 20 can now be introduced into the magazine in the manner indicated in FIG. 3. The bracket 30 is then released from the abutments 26, pivoted into the vertical position and arrested in said position by the pin 35 re-engaging in the cutout 33. The spring 27 presses the carriage 21 forwardly and all the parts are again in the operating position illustrated in FIGS. 1 and 2.

It is easily possible to adapt the target changer described to targets of different sizes. For this purpose, all that need be done is to insert into the existing target guide 18 the insert 56 illustrated in FIG. 4, which has lateral guide slots 57 whose spacing corresponds to the width of a smaller target. This insert has a cover plate 58 which leaves a window 59 free which corresponds to the dimensions of the smaller target. An alternative possibility for adapting to different target sizes resides in that the target guide 18 may be removed and replaced by different identical target guides adapted to the dimensions of different targets.

Figure 2:
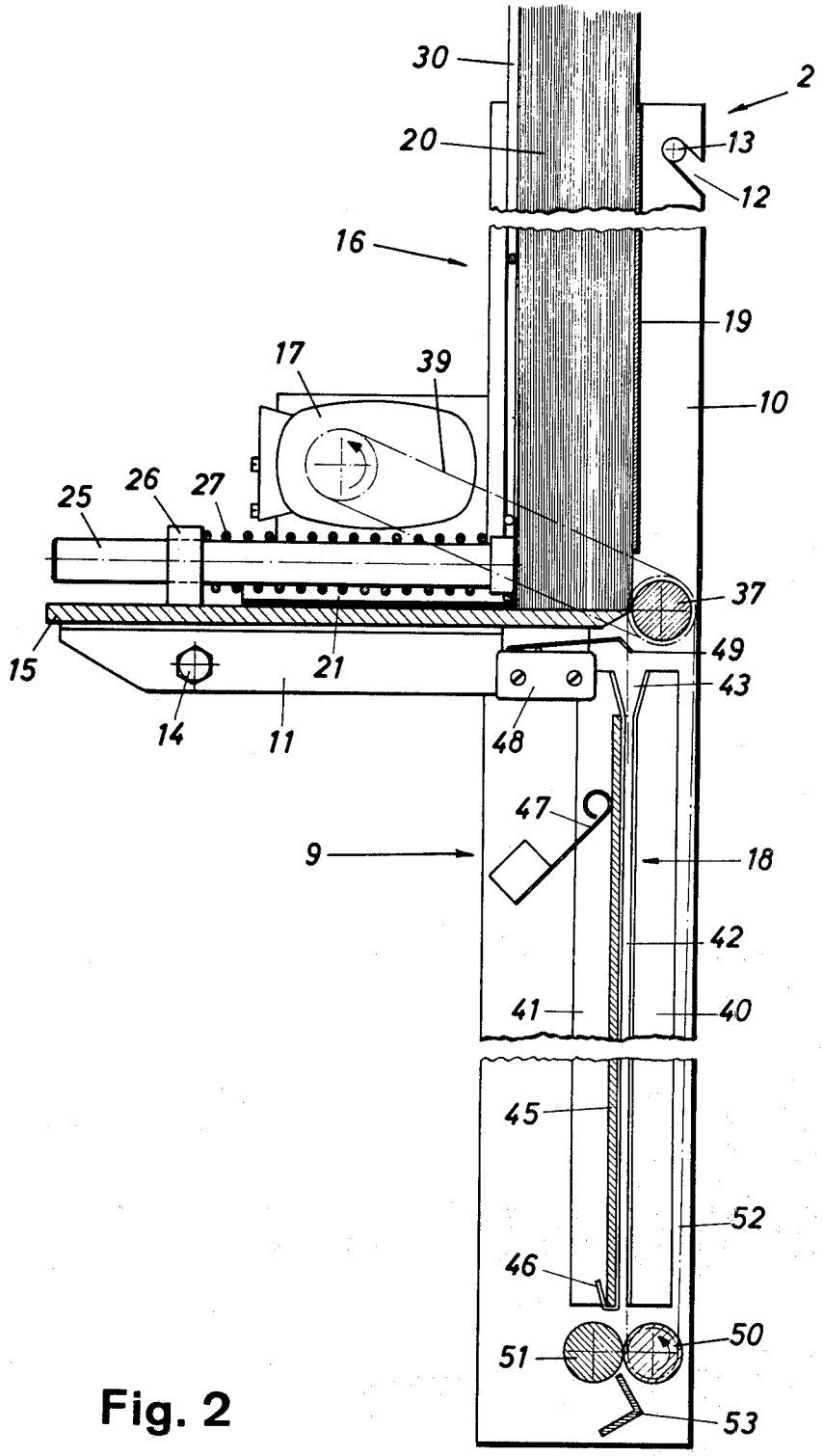
FIG. 2 is an enlarged fragmentary view of the supply magazine and the target guide of the target changer of FIG. 1.
Figure 3:
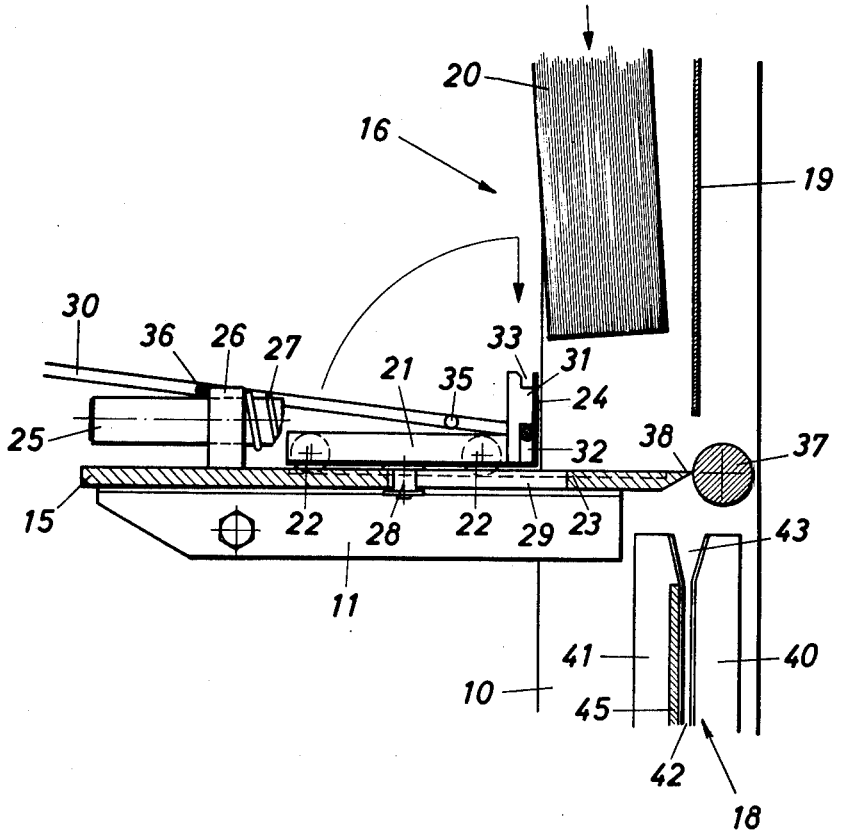
FIG. 3 is a fragmentary view of the supply magazine to explain the charging.
Figures 5, 6:
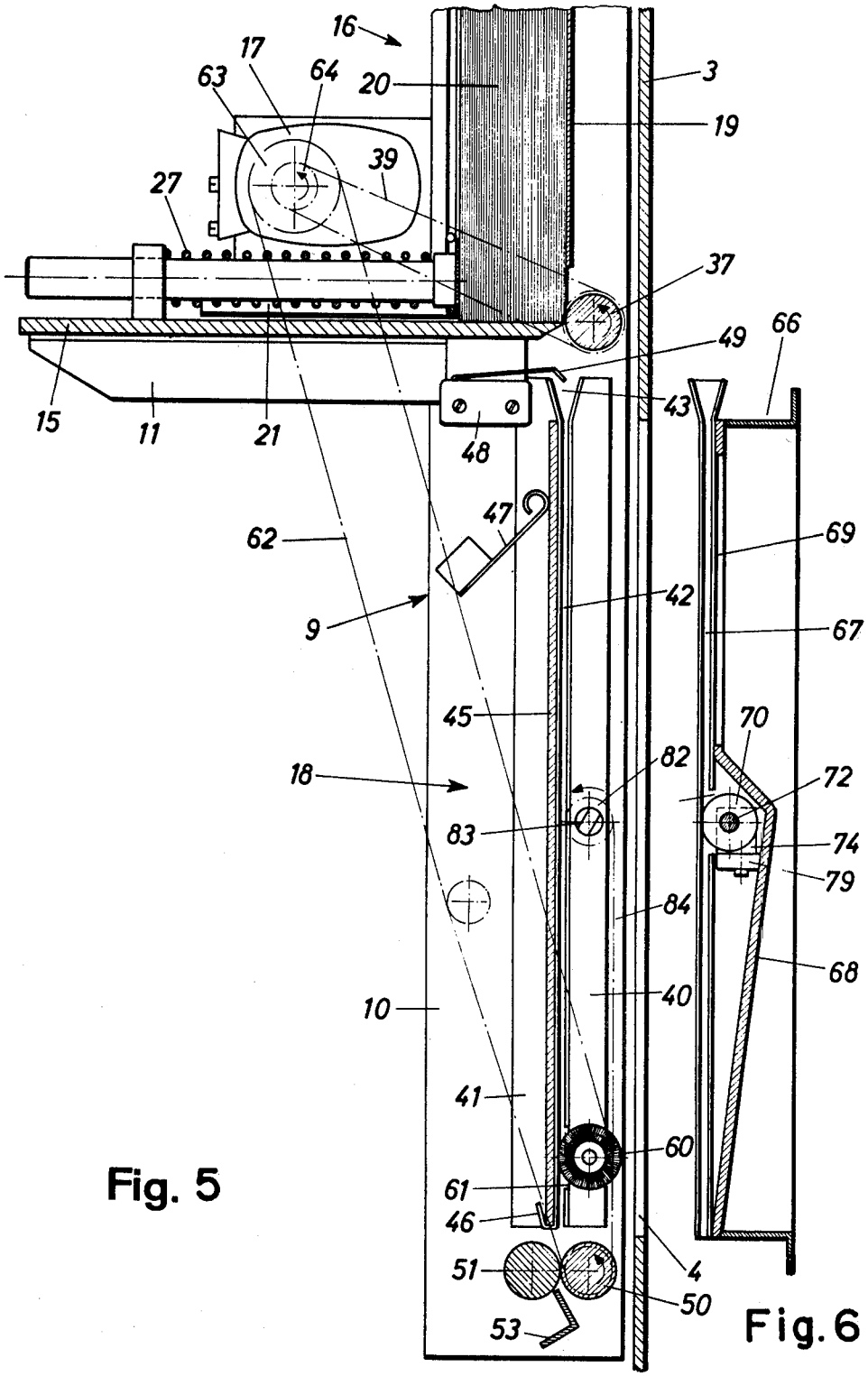
FIG. 5 is a lateral sectional view of a portion of the supply magazine and of the target guide in a second embodiment of the target changer according to the invention.
FIG. 6 is a lateral sectional view of an insert for smaller size targets insertable into the target guide of the target changer of FIG. 5.

FIG. 5 shows a portion of the magazine and the target guide in a lateral sectional view corresponding to FIG. 2 for a modified embodiment, the same reference numerals as those used in FIG. 2 being employed to designate corresponding parts.

The embodiment of FIG. 5 differs from that of FIG. 2 in that it comprises two advancing rollers 60 each of which is mounted rotatably about a horizontal axis on each of the two front vertical guide angle members 40 near the lower end thereof. Each of these two advancing rollers 60, of which only one is visible in the sectional view of FIG. 5, projects through a cutout 61 of the respective guide angle member 40 into the guide slot 42 so that said advancing roller engages the marginal portion of the target disposed in the guide slot 42. To obtain a good grip the advancing rollers 60 are constructed as circular wire brushes. The rear guide angle member 41 serves as back support. The axial dimension of each advancing roller 60 is in the order of the width of the corresponding guide slot 42 between the two angle members 40 and 41.

The distance of the advancing rollers 60 from the upper feed roller 37 corresponds substantially to the height of a target so that the advancing rollers 60 engage each target conveyed from the magazine 16 downwardly into the target guide substantially at the instant in which the upper edge of the target passes the feed roller 37.

The advancing rollers 60 are driven jointly with the drive roller 50 via a chain 62 by the motor 17. The transmission ratio is dimensioned so that the advancing rollers 60 and the drive roller 50 are driven with a greater speed than the feed roller 37 so that the peripheral speed governing the conveying speed of the targets is also greater. In the illustrated example this is achieved in that the sprocket 63 driving the chain 62 and mounted on the output shaft of the motor 17 has a greater diameter than the sprocket 64 driving the chain 39. The second advancing roller 60, not visible in FIG. 1, may for example be driven via a short chain by a sprocket mounted on the other side of the drive roller 50.

This embodiment of the target changer operates in the manner described below, assuming that the parts are in the position illustrated in which a stack 20 of targets is inserted into the magazine 16 and pressed by the pressure means formed by the carriage 21 forwardly against the support plate 19, no target yet being in the target guide 18.

To introduce a target int the guide 18, the operator presses a pushbutton switch, not illustrated, which starts the motor 17. The motor 17 drives the feed roller 37 via the chain 39 and the drive roller 50 and the advancing roller 60 via the chain 62. The feed roller 37 conveys the frontmost target of the stack 20 from the magazine 16 downwardly into the target guide 18. The lower edge of the target strikes the actuating finger 49 of the limit switch 48, which is thus closed and keeps the circuit of the motor 17 closed even after release of the pushbutton switch. The target is thus conveyed further downwardly into the target guide 18 until its upper edge leaves the feed roller 37. At this instant the target is engaged at both lateral marginal portions by the advancing rollers 60 and constrained to advance further until the upper edge of the target releases the actuating finger 49 of the limit switch 47, the latter then interrupting the circuit of the motor 17 and stopping said motor.

The target is now in the target guide and can be used for firing practice as described. It is held by the advancing rollers 60 in the position reached on switching off the motor 17, in which its lower edge has substantially reached the level of the conveying roller pair 50, 51.

Until the motor 17 is stopped, the feed roller 37 is further driven so that it has already started to convey the next target downwardly out of the magazine 16. Due to the greater peripheral speed of the advancing rollers 60, however, the previously extracted target moves downwardly with a greater speed than the following target and consequently a gap permitting release of the actuating finger 49 forms between the two targets.

The action of the advancing rollers 60 obviates the possibility of any sticking of the extracted target after leaving the feed roller 37, which would keep the limit switch 48 closed. Otherwise, the drive motor 17 would not be stopped and the feed roller 37 would be continuously driven and further convey targets downwardly out of the magazine. This could lead to a jamming or to the stuck target being pushed downwardly and being led off by the likewise further driven conveying roller pair 50, 51 without being used.

To exchange the used target for a fresh one, the operator again presses the pushbutton switch, restarting the motor 17. The next target is thereby conveyed in the manner previously described from the magazine 16 into the target guide 18. However, at the same time the used target is now extracted by the conveying roller pair 50, 51 downwardly out of the target guide, even if the target offers a certain resistance to this movement, for example due to any jagged bullet holes. The forced feed effected by the advancing rollers 60 assures that the used target is reliably engaged by the conveying rollers 50, 51.

This embodiment of the target changer can also be adapted to targets of different sizes. To this end the insert 66 illustrated in FIG. 6 can be inserted into the existing target guide 18, said insert having lateral guide slots 67 whose spacing corresponds to the width of a smaller target. Said insert has a cover plate 68 which leaves a window 69 free in the upper portion of the insert, said window corresponding to the dimensions of the smaller target.

The insert 66 for smaller targets is also constructed in such a manner that an uninterrupted constrained feed of the targets is effected from the upper feed roller 37 up to the lower conveying roller pair 50, 51.

For this purpose, on each side of the insert 66 an advancing roller 70 is mounted rotatably about a horizontal axis in such a manner that it projects through a cutout 71 into the respective guide slot 67 and engages there the marginal portion of the target disposed in the guide slot. The advancing rollers 70 are disposed substantially at half the height of the insert 66 beneath the window 69, so that when the insert is inserted, they are spaced from the upper feed roller 37 a distance corresponding substantially to the height of the smaller target.

Figure 7:
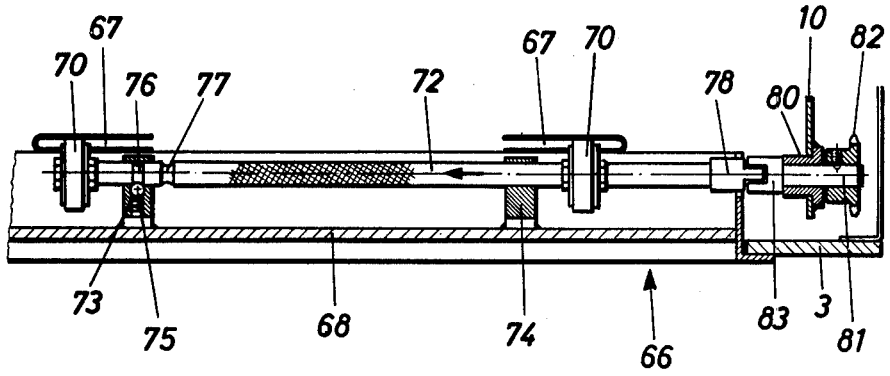
FIG. 7 is a cross-section through the insert of FIG. 6 inserted into the target guide of the target changer of FIG. 5.

The two advancing rollers 70 are fixed to a common shaft 72, which is mounted for rotation in two pedestals 73,74 and is axially displaceable through a limited distance (FIG. 7). Disposed in the pedestal 73 is a detent means in the form of a spring-loaded ball 75 which can engage in either of two grooves 76,77 formed a small distance apart in the shaft 72. The shaft can thus be arrested in two positions against longitudinal displacement but is freely rotatable in said positions. At the end of the shaft 72 a coupling member 78 is mounted.

The entire mechanism is arranged behind the cover plate 68 which is arched for this purpose. The pedestals 73, 74 are mounted adjustably on support plates 79 (FIG. 6) which are welded to the back of the cover plate 68. The application pressure with which the advancing rollers 70 engage the targets is thus adjustable.

On one of the two vertical beams 10 a shaft bearing 80 is mounted at a level such that when the insert 66 is inserted said bearing is coaxial with the shaft 72. Mounted in the shaft 80 is a short shaft length 81 which carries on one side a sprocket 82 and on the other side a counter coupling member 83 which is so constructed that the coupling member 78 can be engaged therewith by longitudinal displacement of the shaft 72. The sprocket 83 is connected via a chain 84 to a sprocket mounted on the shaft of one of the two advancing rollers 60 so that the coupling member 83 is always driven jointly with the advancing rollers 60.

To insert the insert 66 into the target changer the shaft 72 is first displaced to the left (in FIG. 7) so that the ball 75 engages in the groove 77. When the insert 66 has been inserted into the target guide 18 the shaft 72 is moved to the right so that the coupling member 78 engages the counter coupling member 83; in this position it is secured against longitudinal displacement by the ball 75 engaging in the groove 76. The advancing rollers 70 are driven in this position jointly with the advancing rollers 60 and the drive roller 50.

If the pushbutton switch is actuated when the parts are in this position the target changer operates in the previously described manner, with the sole difference that the advancing rollers 70 now effect the forced feed of the target from the upper feed roller 37 to the lower conveying roller pair 50, 51. Thus, trouble due to sticking targets is impossible when an insert 66 is used as well.

When a target releases the actuating finger 49 and thus stops the motor 17, said target is in the upper portion of the insert 66 behind the window 69. It is held in this position by the advancing rollers 70.

Figure 8:
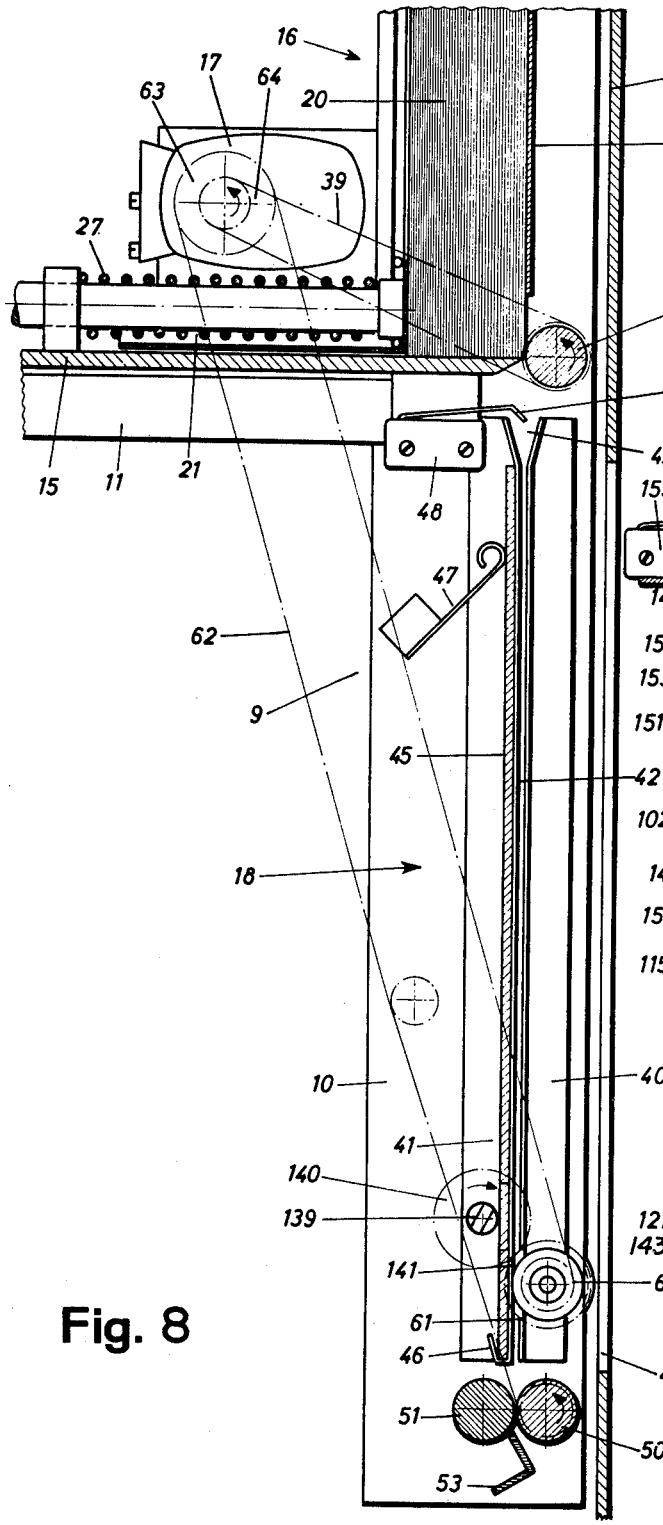
FIG. 8 is a lateral sectional view of a portion of the supply magazine and the target guide of a modified embodiment of the target changer of FIG. 5.
Figure 9:
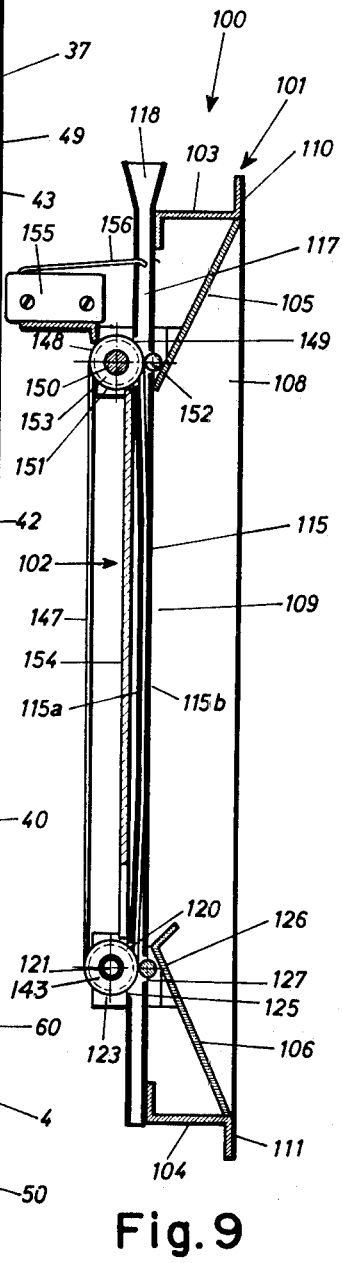
FIG. 9 is a lateral sectional view of a modified embodiment of the insert for smaller size targets insertable into the target guide of FIG. 8.
Figure 10:
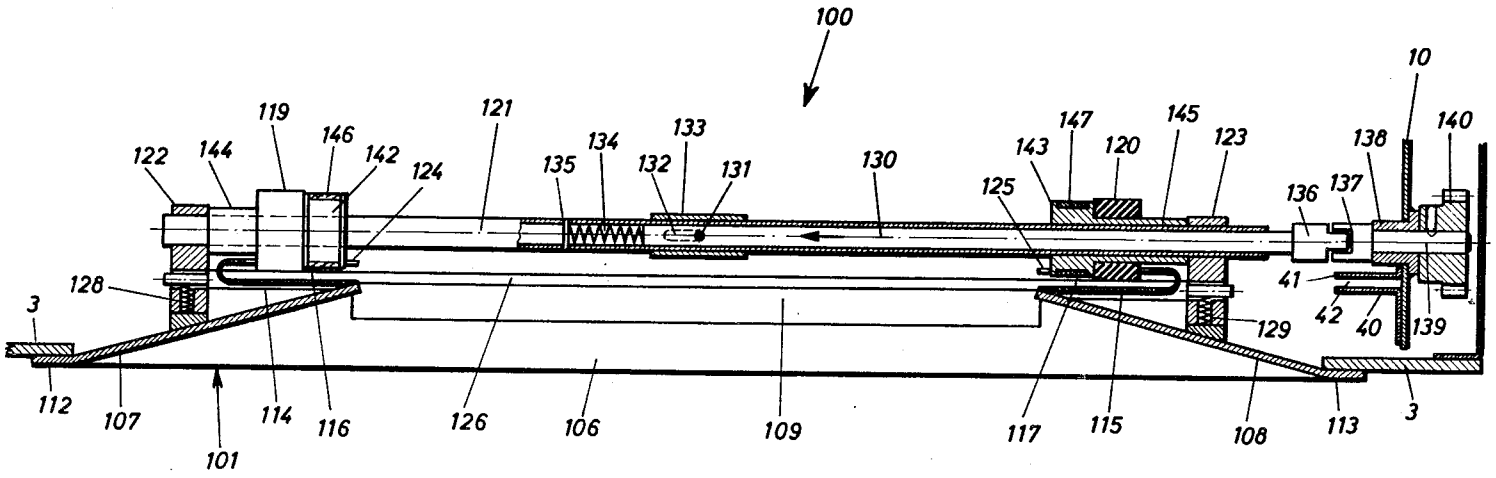
FIG. 10 is a cross-section through the insert of FIG. 9 inserted into the target guide of FIG. 8.

The embodiment of the target changer illustrated in FIGS. 8 to 10 differs from that of FIGS. 5 to 7 substantially only in the different construction of the insert for smaller targets. In the case of the insert 66 illustrated in FIG. 6, the window 69 for the smaller targets lies in the upper portion of the window 4 provided for the large targets. It is however frequently required that the center of the smaller targets be disposed at the same location as the center of the large targets. This condition is met by the insert 100 illustrated in FIGS. 9 and 10, which also effects the desired forced feed of the targets from the upper feed roller 37 to the lower conveying roller pair 50,51.

The insert 100 illustrated in FIGS. 9 and 10 comprises a frame 101, which fits into the window 4 of the target changer, and a target guide 102 mounted at the rear of the frame 101. The frame 101 consists of upper and lower transverse beams 103, 104 which are provided with upper and lower cover plates 105, 106 inclined inwardly (FIG. 9) and lateral cover plates 107, 108 also inclined inwardly (FIG. 10). The inner edges of the cover plates 105, 106, 107, 108 define a rectangular window 109 whose size corresponds to the desired shooting area of the smaller targets and whose center coincides with the center of the large window 4 when the insert 100 is inserted. To enable the insert 100 to be secured in the correct location in the window 4 the transverse beams 103, 104 and the lateral cover plates 107, 108 are provided with laterally projecting flanges 110, 111, 112, 113 which bear against the front face of the front plate 3 and are connected thereto by suitable securing means (not illustrated), such as screws.

The target guide 102 is formed by two U-shaped vertical sheet-iron guide members 114, 115 which are mounted behind the lateral cover plates 107, 108, each of which guide members forms a guide slot 116 and 117, respectively; said guide slots receive the lateral edges of the smaller targets. The depth of the frame 101 is so dimensioned that with the insert inserted (FIG. 10) the guide slots 116, 117 lie in a plane with the guide slots 42 which are formed between the guide angle members 40 and 41 of the target guide 18 for the large targets. At the upper end each guide member comprises a funnel-like widened portion 118 as illustrated in FIG. 9 for the guide member 115. With the insert 100 inserted said funnel-like widened portions 118 lie in a plane with the funnel-like widened portions 43 of the target guide 18 beneath the exit slot of the supply magazine 16 formed between the feed roller 37 and the front edge of the plate 15, and the lower ends of the guide members 114, 115 are then above the nip between the conveying rollers 50 and 51. For the forced feed of the smaller targets, on each side of the target guide 102 two motor-driven rubber advancing rollers are arranged so as to engage the marginal portions of the target disposed in the guide slots 116, 117; two of these advancing rollers are disposed just above the upper edge of the window 109, and the other two advancing rollers are disposed just below the lower edge of the window 109. The two lower advancing rollers 119, 120 and their mounting can be seen in FIG. 10. The two advancing rollers 119, 120 are mounted on a common horizontal shaft 121 which is rotatably mounted in pedestals 122, 123. The pedestals 122, 123 are mounted behind the cover plates, 106,107,108 in such a manner that the shaft 121 lies below the upper edge of the lower cover plate 106 (FIG. 9). The advancing roller 119 projects through a cutout 124 in the rear leg of the guide member 114 into the guide slot 116 and the advancing roller 120 projects through a cutout 125 in the rear leg of the guide member 115 into the guide slot 117. Rotatably mounted in the pedestals 122, 123 parallel to the shaft 121 is a pressure roller 126 of smaller diameter which extends over the entire width between the pedestals and also projects through cutouts in the front legs of the guide members 114, 115 (of which only the cutout 127 can be seen in FIG. 9) into the guide slots 116, 117. Pressure springs 128, 129 mounted in the pedestals 122, 123 urge the pressure roller 126 against the advancing rollers 119, 120.

The shaft 121 is constructed as a hollow shaft. Inserted into the inside of the hollow shaft 121 is a drive shaft 130 which extends over somewhat more than half the hollow shaft 121 and projects from the right end (FIG. 10) thereof. The drive shaft 130 is connected by a transverse pin 131 extending outwardly through longitudinal slots 132 in the hollow shaft 121 to a sleeve-like shift grip 133 which surrounds the hollow shaft 121 slideably substantially in the center thereof. The drive shaft 130 is connected by the pin-and-slot connection 131, 132 to the hollow shaft 121 for common rotation therewith but can be displaced together with the shift grip 133 axially relatively to the hollow shaft 131 through a distance determined by the length of the slots 132. A spring 134 bearing at one end on the end of the drive shaft 130 and at the other on a transverse pin 135 disposed within the hollow shaft 121 tends to press the drive shaft 130 outwardly out of the hollow shaft 121. Secured to the end of the drive shaft 130 projecting from the hollow shaft 121 is a coupling member 136 which by longitudinal displacement of the drive shaft 130 can be brought into engagement with a counter coupling member 137 which is part of a drive mechanism which is similar to the drive mechanism comprising the parts 80, 81, 82, 83 of FIG. 5; it comprises a shaft bearing 138 mounted in the vertical beam 10, a short shaft length 139 rotatably mounted in the shaft bearing 138 and carrying at one end the counter coupling member 137 and a gear 140 mounted on the other end of the shaft length 139. In contrast to the embodiment of FIGS. 5 to 7, however, this drive mechanism is not disposed at substantially half the height of the target guide 18 but as shown in FIG. 8 near the lower end thereof at a level such that the shaft length 139 lies coaxial with the hollow shaft 121 when the insert 100 is inserted into the window 4.

The gear 140 meshes with a gear 141 mounted on the shaft of one of the advancing rollers 60. The transmission ratio is so dimensioned that the advancing rollers 119, 120, like the advancing rollers 60, are driven with a somewhat greater peripheral speed than the upper feed roller 37 so that the conveying speed of the targets produced by them is also somewhat greater.

In order to insert the insert 100 into the target guide 18 the drive shaft 130 is drawn by means of the shift grip 133 inwardly into the hollow shaft 121; on release of the shift grip the spring 134 presses the drive shaft 130 outwardly, the coupling member 136 thus being brought into engagement with the counter coupling member 137. The drive connection is thus established and the shaft 121 and thus also the advancing rollers 119, 120 are driven via the gears 140, 141 together with the advancing roller 60 and the drive roller 50 by the electric motor 17.

Mounted on the hollow shaft 121 are two pulleys 142, 143 integrally formed with sleeves 144 and 145, respectively, which serve at the same time as support for the rubber advancing rollers 119 and 120, respectively. The pulleys 142, 143 drive the upper advancing rollers via belts 146, 147. The pulleys have together with the thickness of the belts thereon approximately the same outer periphery as the advancing rollers 119, 120.

The two upper advancing rollers are constructed and arranged substantially in the same manner as the lower advancing rollers 119, 120. In FIG. 9 the one upper advancing roller 148 can be seen, projecting through a cutout 149 into the guide slot 117. The second upper advancing roller is not shown in the drawings but projects into the guide slot 116 and is also to be designated 148. The two upper advancing rollers 148 are mounted on a horizontal shaft 150 which lies somewhat above the lower edge of the cover plate 105 and is mounted at both ends in bearing pedestals, the pedestal 151 being visible in FIG. 9.

Also mounted in these pedestals is a pressure roller 152 which in the same manner as the lower pressure roller 126 projects through cutouts in the lower guide plates 114, 115 into the guide slots 116, 117 and is pressed resiliently against the upper advancing rollers 148. The upper shaft 150 may be made solid; it carries two pulleys which are constructed and arranged in the same manner as the pulleys 142, 143 of the lower shaft 121 and connected to said pulleys via the belts 146, 147; in FIG. 9 the upper pulley 153 can be seen and is connected via the belt 147 to the lower pulley 143.

By means of the belts 146, 147 the upper and lower advancing rollers are driven with the same speed. Said belts additionally serve to hold the target in the target guide 102 on both sides. For this purpose, the rear leg of each guide member 114, 115 is arched somewhat forwardly as shown in FIG. 9 for the rear leg **115*a* of the guide member 115 so that the distance from the front leg 115*b* is smallest in the middle between the upper advancing roller 148 and the lower advancing roller 120. In this region the run of the belt 147 going downwardly in the guide slot 117 is thus pressed against the back of the marginal portion of the target disposed in the guide slot 117, additionally securing said target. This permits in particular the use of a larger window 109**; although only relatively narrow lateral edge portions of the targets are then disposed in the guide slots, the targets are held securely by the belts.

With the embodiment described, to insert the insert 100 into the target guide 18 the cardboard 45 must be removed; the insert 100 is provided with its own cardboard 154.

Furthermore, the limit switch 48 cannot be used for the insert 100 because its actuating finger 49 is at too high a level for the targets of smaller size; said limit switch would switch off the target feed before the smaller targets were completely introduced into the window 109. For this reason a separate limit switch 155 is provided on the insert 100 in such a manner that its actuating finger 156 lies at the correct level for the smaller targets. By means of a plug-type connection (not illustrated) the limit switch 155 is connected into the circuit of the electric motor 17 when the insert 100 is inserted, simultaneously rendering the limit switch 48 inoperative.

The mode of operation of the target changer with the insert 100 in place is immediately apparent from the preceding explanations. When the electric motor 17 is started for a target change said motor drives the upper feed roller 37, the lower conveying roller pair 50, 51 and the lower advancing rollers 119, 120 together with the upper advancing rollers 148 of the insert 100. The used target disposed in the target guide 102 is forced downwardly and conveyed to the conveying roller pair 50, 51 by the advancing rollers 119, 120 in cooperation with the pressure roller 126 and the belts 146, 147 and is engaged by said conveying roller pair 50, 51 and passed to the used target receiver. The upper feed roller 37 pushes the frontmost target of the stack 20 into the target guide 102 where said target is engaged between the upper advancing rollers 148 and the pressure roller 152. Since the upper advancing rollers 148 rotate with a greater peripheral speed than the feed roller 37, slip takes place for as long as the target is not free of the feed roller 37, the upper advancing rollers 148 slipping on the target.

This slip is advantageous because it exerts a tension on the target which renders the latter taut and avoids arching. As soon as the upper edge of the target has left the feed roller 37 it is driven with the increased speed of the advancing rollers 119, 120, 148 and the belts 146, 147 whilst the next target is conveyed with the lower speed of the feed roller 37 out of the magazine. Due to the different conveying speeds an increasingly larger gap is formed between the two targets and permits the release of the actuating finger 156. As soon as the upper edge of the new target has left the actuating finger 156 the limit switch 155 stops the electric motor 17. The target is now disposed in the correct position in the window 109; it is held fixed in this position on the one hand by the clamping pressure between the upper and lower advancing and pressure rollers and on the other by the belts 146, 147.

What we claim is:

1. A target changer for use on a shooting range comprising (a) a window;

(b) a supply magazine disposed above the level of said window and adapted to receive a stack of individual targets;

(c) a vertical main target guide disposed behind said window;

(d) a used target receiver disposed beneath the level of said window for receiving the targets discharged downwardly out of said main target guide;

(e) a first feed mechanism driven by electric motor drive means for conveying the respective first target of the stack to said vertical main target guide; and (f) a pair of conveyor rollers disposed at the lower end of said main target guide as a support for the lower edge of the target disposed in said main target guide and driven by electric motor drive means for positively conveying said target out of said main target guide to said used target receiver.

2. A target changer according to claim 1, comprising a stop arranged beneath said conveyor rollers and above the used target receiver in the path of the used target conveyed downwardly by said conveyor roller pair.

3. A target changer according to claim 2, comprising a deflector disposed beneath said conveyor rollers to deflect the lower edge of the used target conveyed downwardly by said pair of conveyor rollers towards said stop.

4. A target changer according to claim 1, wherein said supply magazine is disposed vertically above said main target guide in such a manner that the frontmost target of the stack is disposed above the entry of said main target guide, and wherein the supply magazine comprises a support plate for the frontmost target of the stack fixedly mounted over the entry of said main target guide and a spring-loaded pressure means bearing on the rearmost target of the stack.

5. A target changer according to claim 4, wherein the pressure means is mounted on a carriage which is displaceable towards the support plate and retractable against the force of a spring.

6. A target changer according to claim 5, wherein the carriage carries a pivotal bracket which in the vertical position bears on the rearmost target of the stack.

7. A target changer according to claim 4, wherein the first feed mechanism comprises a feed roller bearing above said main target guide on the frontmost target of the stack and driven by an electric motor, and wherein beneath the stack a support plate is disposed whose front edge forms with the feed roller a gap having essentially the thickness of a target.

8. A target changer according to claim 1, wherein on each side of said main target guide an advancing roller driven by an electric motor drive means is disposed in such a manner that said advancing roller engages the marginal portion of the target disposed in said main target guide.

9. A target changer according to claim 8, wherein each advancing roller comprises a circular wire brush.

10. A target changer according to claim 1, comprising an insert having a window and an insert target guide adapted to targets of smaller size, said insert being insertable into said main target guide so that said insert target guide receives the targets conveyed by said first feed mechanism and used targets are conveyed out of said insert target guide towards said used target receiver by said conveyor rollers, at least one advancing roller driven by electric motor drive means being disposed on each side of said insert target guide so as to engage the marginal portion of the target disposed in the target guide of in the insert.

11. A target changer according to claim 10, wherein the window for the targets of smaller size is disposed substantially in the center of the insert, two advancing rollers are disposed substantially at the level of the upper edge of the window, two further advancing rollers are disposed substantially at the level of the lower edge of the window and means are provided for the common drive of the advancing rollers.

12. A target changer according to claim 11, wherein each pair of upper and lower advancing rollers lying on the same side of the target guide is connected by a belt which effects the common drive.

13. A target changer according to claim 12, wherein the belts disposed on both sides of the insert target guide are so constructed and arranged that they engage the marginal portion of the target disposed in the insert target guide.

14. A target changer according to claim 13, wherein the target guide comprises lateral guide members which are so arched that in the center portion between the upper and lower advancing rollers each belt is pressed against the marginal portion of the target.

15. A target changer according to claim 11, comprising a coupling for coupling the advancing rollers of the insert to the electric motor.

16. A target changer according to claim 15, wherein two advancing rollers of said insert are mounted on a common horizontal shaft which is displaceable between two positions in its longitudinal direction and said shaft carries at one end a coupling member which, when said insert is inserted by displacement of said shaft, can be brought into engagement with a counter coupling member mounted on said target changer and driven by said electric motor.

17. A target changer according to 16, comprising a detent means for securing said shaft against longitudinal displacement in either of said two positions.

18. A target changer according to claim 15, wherein two advancing rollers of said insert are mounted on a common shaft, a drive shaft is arranged coaxially to the common shaft for common rotation therewith but axially displaceable with respect thereto, said drive shaft carrying at its end a coupling member which, with the insert inserted by axial displacement of the drive shaft, can be brought into engagement with a counter coupling member mounted on said target changer and driven by said electric motor.

19. A target changer according to claim 18, comprising a spring which biases said drive shaft in the axial direction in the direction of the engagement of said coupling member with said counter coupling member.

20. A target changer according to claim 12, wherein the upper advancing rollers are disposed on a common horizontal shaft, the lower advancing rollers are disposed on a common horizontal shaft and on each shaft adjacent each feed wheel a pulley is disposed over which the associated belt is placed.

* * * * *

UNITED STATES PATENT AND TRADEMARK OFFICE

CERTIFICATE OF CORRECTION

PATENT NO. : 4,195,840

DATED : APRIL 1, 1980

INVENTOR(S) : E. K. SPIETH ET AL.

It is certified that error appears in the above—identified patent and that said Letters Patent is hereby corrected as shown below:

the priority application numbers should read -- 2713336 -- and -- 2741743 --.

in line 5 of the section entitled "Inventors", "both" should read --all--.

Signed and Sealed this

*Twenty-third* Day of *December 1980*

[SEAL]

*Attest:*

SIDNEY A. DIAMOND

*Attesting Officer*

*Commissioner of Patents and Trademarks*